US011799224B2

(12) United States Patent
Kobayashi et al.

(10) Patent No.: US 11,799,224 B2
(45) Date of Patent: Oct. 24, 2023

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroki Kobayashi, Mie (JP); Yasuo Omori, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 398 days.

(21) Appl. No.: 17/280,796

(22) PCT Filed: Oct. 7, 2019

(86) PCT No.: PCT/JP2019/039429
§ 371 (c)(1),
(2) Date: Mar. 26, 2021

(87) PCT Pub. No.: WO2020/085056
PCT Pub. Date: Apr. 30, 2020

(65) Prior Publication Data

US 2022/0006218 A1 Jan. 6, 2022

(30) Foreign Application Priority Data

Oct. 26, 2018 (JP) ..... 2018-201637

(51) Int. Cl.
*H01R 12/77* (2011.01)
*H01R 13/424* (2006.01)
*H01R 13/502* (2006.01)

(52) U.S. Cl.
CPC ..... *H01R 12/772* (2013.01); *H01R 13/424* (2013.01); *H01R 13/502* (2013.01)

(58) Field of Classification Search
CPC .. H01R 12/772; H01R 13/424; H01R 13/502; H01R 13/506; H01R 12/778
See application file for complete search history.

(56) References Cited

U.S. PATENT DOCUMENTS 3,149,896 A * 9/1964 Hall ..... H01R 12/79 439/495
4,382,652 A * 5/1983 Sinclair ..... H01R 12/778 439/936

(Continued)

FOREIGN PATENT DOCUMENTS

JP H04-021077 U 2/1992
JP H11-329620 A 11/1999
JP 2012-084501 A 4/2012

OTHER PUBLICATIONS

International Search Report dated Dec. 17, 2019 for WO 2020/085056 A1 (4 pages).

*Primary Examiner* — Abdullah A Riyami
*Assistant Examiner* — Nader J Alhawamdeh
(74) *Attorney, Agent, or Firm* — Venjuris, P.C.

(57) ABSTRACT

It is aimed to provide a connector capable of suppressing the generation of an excessive stress in a connecting part of a flat cable and a terminal. A connector is provided with a flat cable (60) including a hole (64) serving as a receiving portion, a housing (10) including an installation surface (19) on which the flat cable (60) is arranged and a protrusion (21) projecting from the installation surface (19) and to be (Continued)

inserted into the hole (64), and a terminal (90) to be connected to a conductor (70) of the flat cable (60) and locked to the housing (10). The flat cable (60) includes an extra length portion (66) providing an extra length as compared to flat arrangement on the installation surface (19) in a part surrounding the protrusion (21) or a part arranged between the terminal (90) and the protrusion (21) in an assembled state.

7 Claims, 10 Drawing Sheets

(56) References Cited

U.S. PATENT DOCUMENTS

| | | | | |
|---|---|---|---|---|
| 6,443,758 | B2 * | 9/2002 | Nagai | H01R 13/4361 439/465 |
| 6,939,164 | B2 * | 9/2005 | Noro | H01R 4/2429 439/492 |
| 11,069,994 | B2 * | 7/2021 | Peterson | H01R 43/28 |
| 11,437,752 | B2 * | 9/2022 | Phatiwuttipat | H01R 13/506 |
| 11,611,165 | B2 * | 3/2023 | Kobayashi | H01R 12/77 |
| 2019/0148857 | A1 * | 5/2019 | Takase | H01R 13/5829 439/495 |
| 2022/0029327 | A1 * | 1/2022 | Nagasaka | H01R 12/771 |
| 2022/0045449 | A1 * | 2/2022 | Kobayashi | H01R 13/502 |
| 2022/0123504 | A1 * | 4/2022 | Sato | H01R 12/79 |
| 2022/0190501 | A1 * | 6/2022 | Obata | H01R 12/778 |

* cited by examiner

CONNECTOR

CROSS REFERENCE TO RELATED APPLICATIONS

This application is a national phase of PCT application No. PCT/JP2019/039429, filed on 7 Oct. 2019, which claims priority from Japanese patent application No. 2018-201637, filed on 26 Oct. 2018, all of which are incorporated herein by reference.

TECHNICAL FIELD

The present disclosure relates to a connector.

BACKGROUND

Patent Document 1 discloses a plug connector including an FPC (flexible printed circuit board) having a plurality of contact points and a block into which the FPC is mounted. The plug connector is connected to a socket connector. The respective contact points of the FPC are connected to a plurality of contacts held in the socket connector.

Further, the FPC includes a plurality of holes. The block includes a plurality of projections at positions corresponding to the respective holes. Each projection is inserted into each hole and the FPC is fixed by a holding means by heating.

PRIOR ART DOCUMENT

Patent Document

Patent Document 1: JP 2012-084501 A

SUMMARY OF THE INVENTION

Problems to be Solved

A terminal is connected to a conductor part in a flat cable such as an FPC and this terminal can be connected to a mating terminal of a mating connector (socket connector in the above case). In this case, the terminal is locked to a housing (block in the above case) of the connector by a locking means such as a locking lance. Further, the housing is provided with a protrusion. By configuring the protrusion to penetrate through a hole of the flat cable, the flat cable can be hooked to the protrusion to prevent a displacement of the flat cable when the flat cable receives a pulling force in a direction to come out from the housing.

However, even if the protrusion is configured to penetrate through the hole of the flat cable, a clearance is formed between the protrusion and a hole surface. Thus, the flat cable having received the pulling force is going to be displaced in a range corresponding to the clearance. On the other hand, since the terminal is locked to the housing, if the flat cable is going to be displaced, a stress is generated in a connecting part of the conductor part of the flat cable and the terminal, thereby causing a reduction in the durability (life) of the connecting part.

Accordingly, it is aimed to provide a connector capable of suppressing the generation of an excessive stress in a connecting part of a flat cable and a terminal.

Means to Solve the Problem

A connector of the present disclosure is provided with a flat cable including a receiving portion, a housing including an installation surface and a protrusion, the flat cable being arranged on the installation surface, the protrusion projecting from the installation surface and being inserted into the receiving portion, and a terminal to be connected to a conductor of an end part of the flat cable and locked to the housing, wherein the flat cable includes an extra length portion providing an extra length as compared to flat arrangement on the installation surface in a part surrounding the protrusion or a part arranged between the terminal and the protrusion in an assembled state.

Effect of the Invention

According to the present disclosure, it is possible to provide a connector capable of suppressing the generation of an excessive stress in a connecting part of a flat cable and a terminal.

DETAILED DESCRIPTION TO EXECUTE THE INVENTION

Description of Embodiments of Present Disclosure

Figure 1:
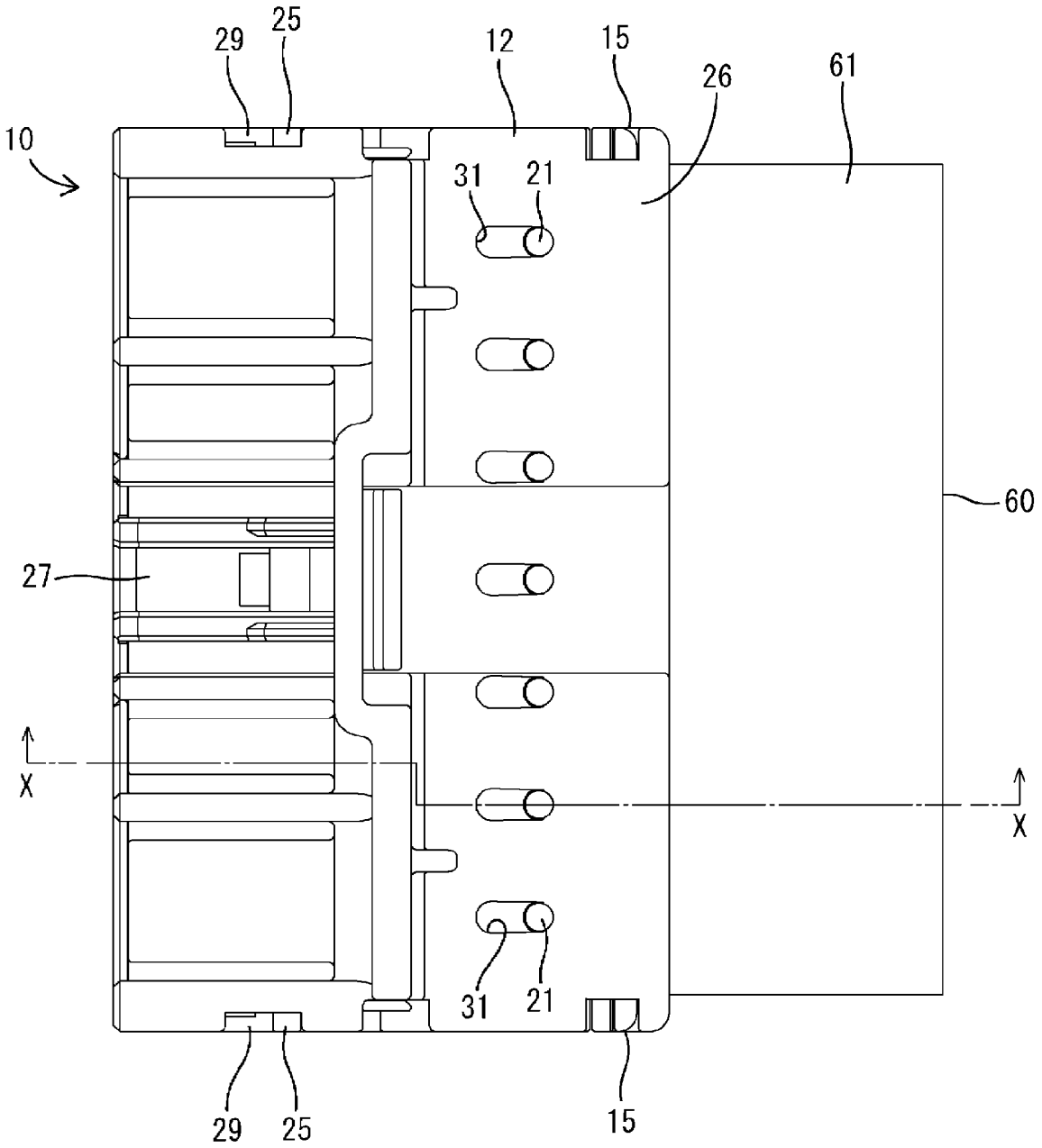
FIG. 1 is a plan view of a connector according to a first embodiment.

First, embodiments of the present disclosure are listed and described.

(1) The connector of the present disclosure is provided with a flat cable including a receiving portion, a housing including an installation surface and a protrusion, the flat cable being arranged on the installation surface, the protrusion projecting from the installation surface and being inserted into the receiving portion, and a terminal to be connected to a conductor of an end part of the flat cable and locked to the housing, the flat cable including an extra length portion providing an extra length as compared to flat arrangement on the installation surface in a part surrounding the protrusion or a part arranged between the terminal and the protrusion in an assembled state. Since the flat cable includes the extra length portion providing an extra length as compared to the flat arrangement on the installation surface in the part surrounding the protrusion or the part arranged between the terminal and the protrusion in the assembled state, a displacement (positional deviation) of the flat cable due to a clearance between the protrusion and the receiving portion can be absorbed by the extra length portion. As a result, the application of an excessive stress to a connecting part of the conductor of the flat cable and the terminal can be avoided, the durability of the connecting part can be improved and a long life can be realized.

(2) Preferably, the flat cable includes a sheet member provided with the receiving portion and the conductor, and a reinforcing member laminated on and integrated with the sheet member, and the receiving portion is defined by the reinforcing member. According to this configuration, since the periphery of the receiving portion of the flat cable is reinforced by the reinforcing member, the deformation of the receiving portion can be prevented when the protrusion interferes with the flat cable.

(3) The extra length portion may be provided in an overlapped state while surrounding the protrusions by fitting a plurality of the receiving portions to the protrusions. According to this configuration, the flat cable can be smoothly assembled while being positioned by the protrusions.

(4) In the above configuration (3), the extra length portion may be provided by being folded. According to this configuration, the enlargement of the flat cable in an overlapping direction of the extra length portion can be avoided. Further, since the extra length portion is unlikely to be detached from the protrusions, the positioning reliability of the flat cable can be enhanced.

(5) The extra length portion may be provided by being bent between the terminal and the protrusion. According to this configuration, the extra length portion can be formed in advance, such as by press-working, before the flat cable is assembled with the housing, and an assembling workload can be reduced.

Details of Embodiments of Present Disclosure

Specific examples of a connector of the present disclosure are described below with reference to the drawings. Note that the present invention is not limited to these illustrations and is intended to be represented by claims and include all changes in the scope of claims and in the meaning and scope of equivalents.

First Embodiment

A first embodiment is described with reference to FIGS. 1 to 7. A connector according to the first embodiment includes a housing 10, a flat cable 60 to be held in the housing 10 and terminals 90 to be connected to the flat cable 60 and accommodated into the housing 10. Note that, in the following description, a vertical direction is based on a vertical direction of FIGS. 2 to 5 and 7, and a left side of FIGS. 1 to 4 is defined as a front side concerning a front-rear direction.

The housing 10 is made of synthetic resin and composed of a lower housing 11 and an upper housing 12 which can be vertically separated and united.

The lower housing 11 has a flat shape and includes a plate-like base wall portion 13 having a rectangular plan view shape, a front wall portion 14 projecting upward from the front end of the base wall portion 13 and a pair of side wall portions 15 (not shown in detail) projecting upward from both widthwise ends of the base wall portion 13.

Figure 2:
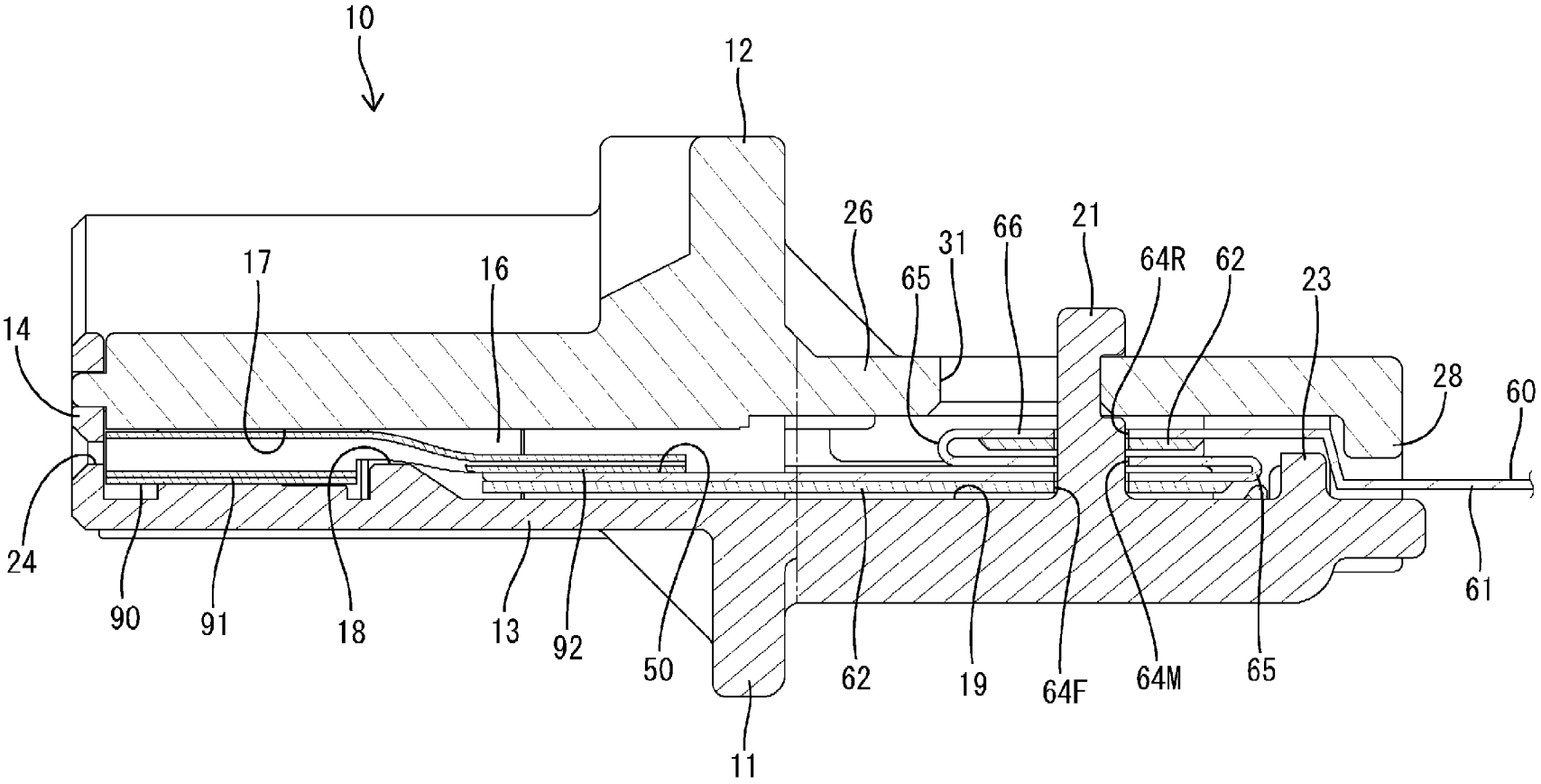
FIG. 2 is a section along X-X of FIG. 1.

The base wall portion 13 includes a plurality of cavities 17 partitioned by separation walls 16 and arranged side by side in a width direction in a front part of an upper surface. The terminal 90 is accommodated into each cavity 17 from above. As shown in FIG. 2, locking lances 18 capable of locking the terminals 90 are provided to project on the upper surface of the base wall portion 13. The locking lance 18 has a trapezoidal cross-sectional shape and can be neither deflected nor deformed.

The base wall portion 13 has a flat installation surface 19 in the form of a horizontal surface not partitioned by the separation walls 16 in a rear part of the upper surface. The flat cable 60 is laid on the installation surface 19 and arranged between the lower housing 11 and the upper housing 12 in a united state.

A plurality of cylindrical protrusions 21 project on the installation surface 19 of the base wall portion 13. The respective protrusions 21 are provided side by side in a row while being spaced apart in the width direction on the upper surface of the base wall portion 13. Each protrusion 21 includes a fitting recess 22 open toward a rear surface side. A lower ridge 23 extending in the width direction projects behind the respective protrusions 21 on the upper surface of the base wall portion 13.

The front wall portion 14 restricts forward movements of the terminals 90 by coming into contact with the front ends of the terminals 90 accommodated in the respective cavities 17. The front wall portion 14 includes a plurality of insertion holes 24 at positions facing the respective cavities 17. When the housing 10 is connected to an unillustrated mating housing, tabs of unillustrated mating terminals mounted in the mating housing are inserted into the insertion holes 24. In this way, the tabs contact the terminals 90 accommodated in the cavities 17 and the both terminals are electrically connected. Each side wall portion 15 includes a pair of lock receiving portions 25 on an outer surface side.

The upper housing 12 has a flat shape and includes a plate-like covering wall portion 26 facing the base wall portion 13 in the united state. As shown in FIG. 1, a deflectable lock arm 27 for holding the mating housing in a connected state projects in a widthwise central part of the upper surface of the covering wall portion 26.

A pair of lock portions 29 project downward on both widthwise ends of the covering wall portion 26. The respective lock portions 29 lock the lock receiving portions 25 of the respective side wall portions 15, whereby the lower housing 11 and the upper housing 12 are held in the united state.

An upper ridge 28 extending in the width direction projects in a rear end part of the lower surface of the covering wall portion 26. As shown in FIG. 2, when the lower housing 11 and the upper housing 12 are in the united state, an L-shaped or crank-shaped strain relief structure is formed between the lower and upper ridges 23, 28. Movements of the flat cable 60 are restricted by the flat cable 60 being bent and held by the strain relief structure between the lower and upper ridges 23, 28.

Figure 3:
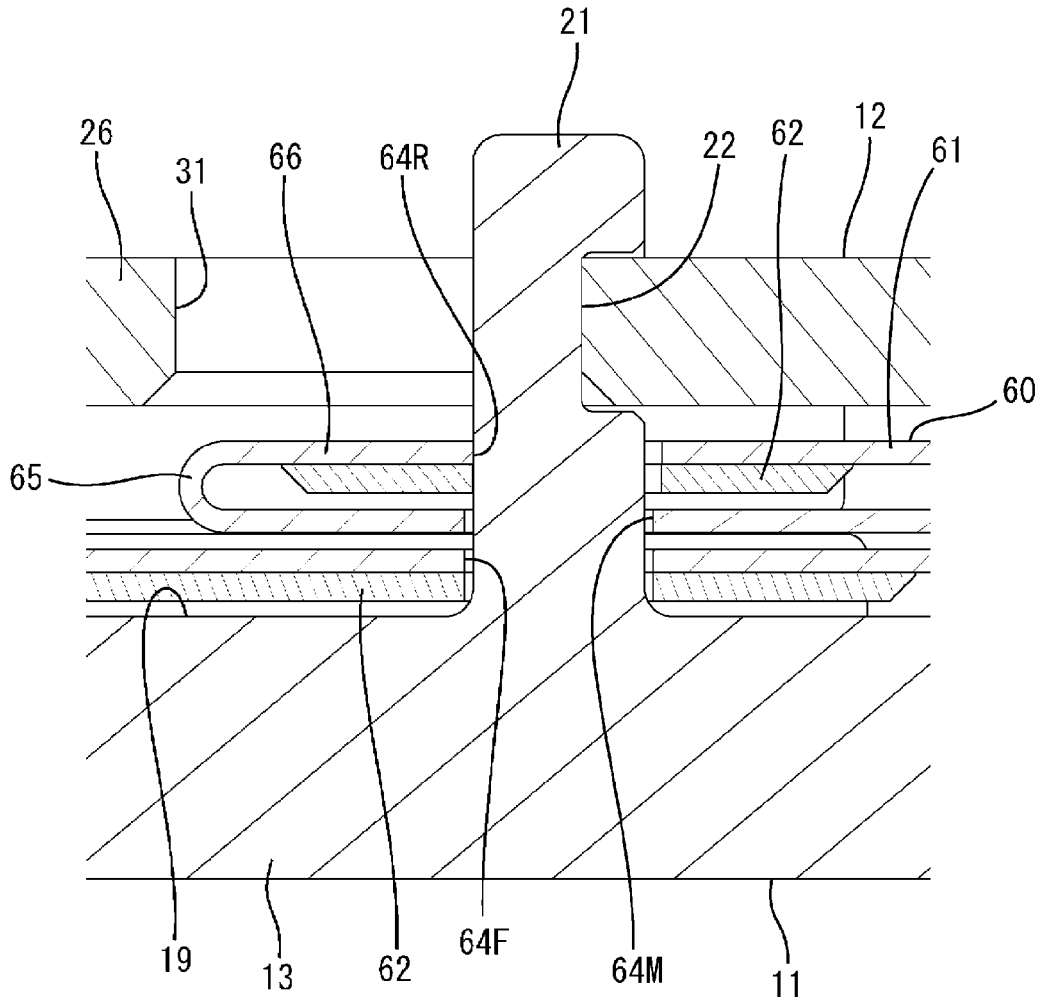
FIG. 3 is an enlarged view of an essential part when a flat cable is pulled in a retracting direction from a state of FIG. 2.
Figure 4:
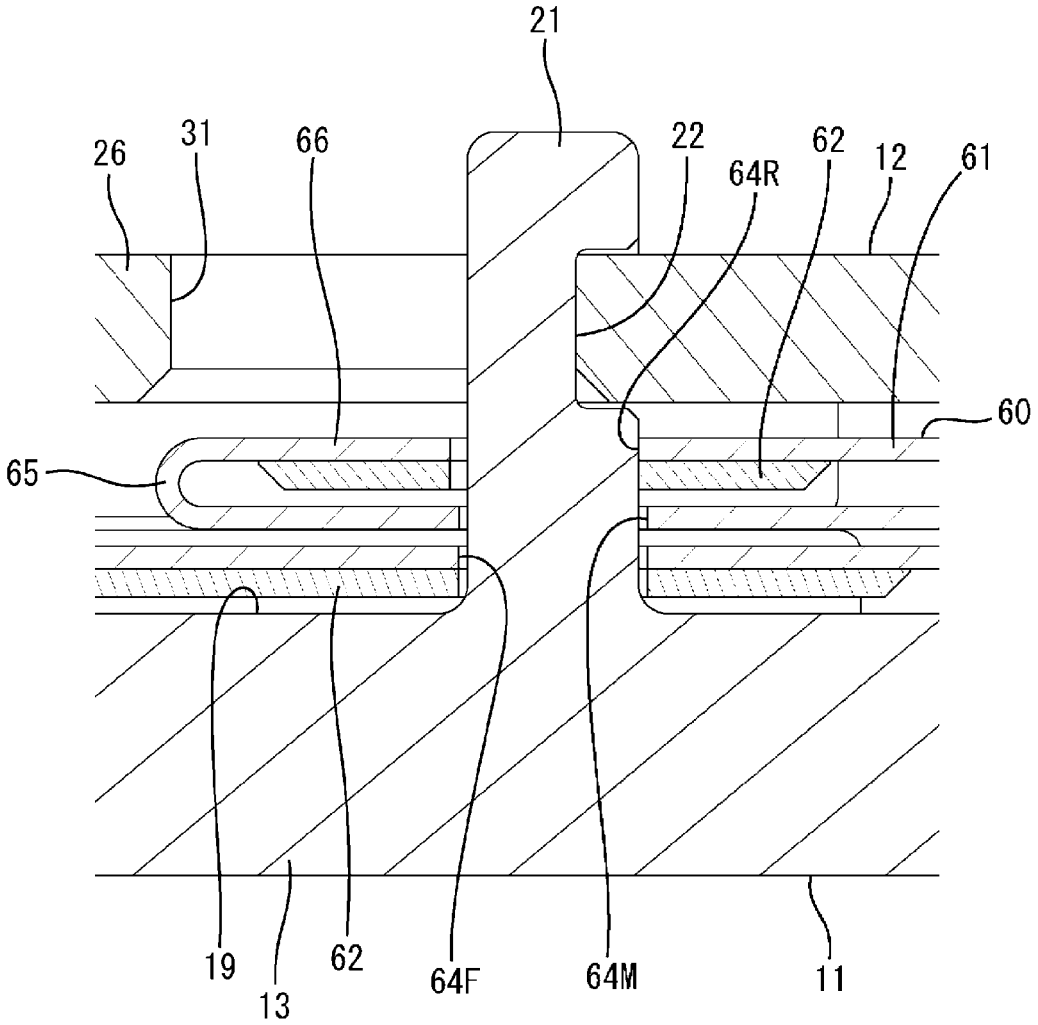
FIG. 4 is an enlarged view of the essential part when the flat cable is pressed in an advancing direction from the state of FIG. 2.

The covering wall portion 26 is provided with a plurality of escaping holes 31 penetrating at positions corresponding to the respective protrusions 21. As shown in FIG. 1, tip parts of the corresponding protrusions 21 are inserted into the respective escaping holes 31. Each escaping hole 31 has a hole shape long in the front-rear direction. In the process of assembling the lower housing 11 and the upper housing 12, the lower housing 11 is relatively retracted with respect to the upper housing 12 and each protrusion 21 is displaced in each escaping hole 31. When the lower housing 11 and the upper housing 12 are properly assembled, a rear end part of each escaping hole 31 enters the fitting recess 22 of each protrusion 21 as shown in FIGS. 3 and 4 to suppress rattling between the lower housing 11 and the upper housing 12.

The flat cable 60 is a deformable plate-like cable such as a flexible printed circuit board or flexible flat cable, and includes an insulating sheet member 61, a plurality of conductors 70 covered by the sheet member 61 and arranged side by side while being spaced apart in the width direction and insulating reinforcing members 62 integrally laminated on the sheet member 61.

Figure 5:
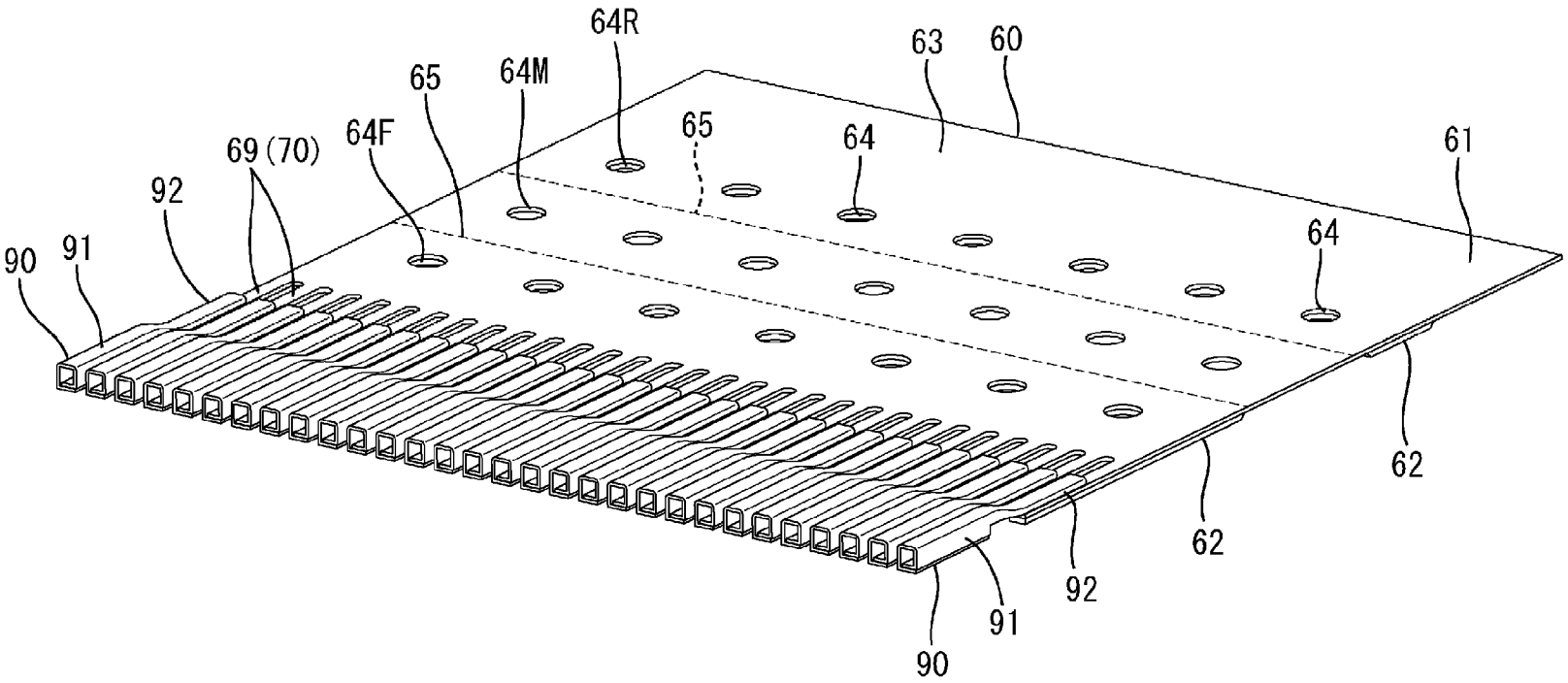
FIG. 5 is a perspective view when the flat cable having terminals connected thereto is in a developed state.
Figure 7:
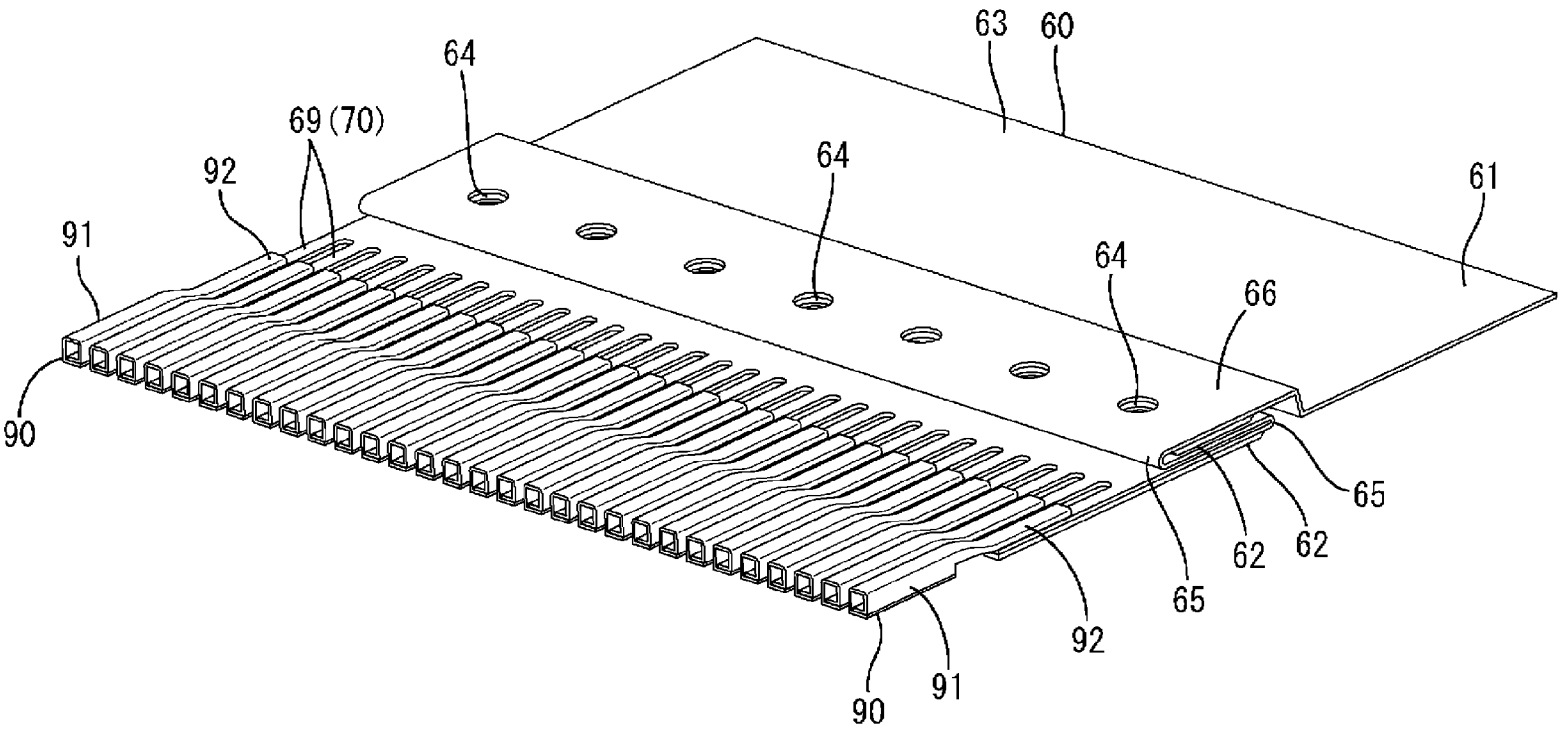
FIG. 7 is a perspective view showing a state where an extra length portion is folded from a state shown in FIG. 5.

As shown in FIGS. 5 and 7, the sheet member 61 includes a sheet body portion 63 having a rectangular plan view shape and a plurality of branch portions 69 projecting forward like comb teeth from the front end of the sheet body portion 63. Each branch portion 69 includes the conductor 70 exposed by peeling insulating resin. The terminal 90 is mounted on the branch portion 69 by being soldered to the exposed conductor 70.

The terminal 90 is formed into a shape elongated in the front-rear direction, such as by bending a conductive metal plate. The terminal 90 includes a tubular body portion 91, into which the tab of the mating terminal is inserted for connection, in a front part and a strip-like conductor connecting portion 92 to be connected to the exposed conductor 70 in a rear part.

The sheet body portion 63 is provided with a plurality of penetrating holes 64 configured as receiving portions. The plurality of holes 64 are provided at positions corresponding to the respective protrusions 21 while being spaced apart in the width direction. When the sheet body portion 63 is in a developed state, the holes 64 are provided in a front row, a middle row and a rear row while being spaced apart in the front-rear direction. Each hole 64 has a circular opening shape and has an opening diameter slightly larger than a diameter of each protrusion 21. The corresponding protrusion 21 is fit and inserted into each hole 64 of the sheet body portion 63.

The sheet body portion 63 includes curved portions 65 along the width direction respectively between the holes 64F in the front row and the hole 64M in the middle row and between the holes 64M in the middle row and the holes 64R in the rear row. The sheet body portion 63 is successively folded into vertically overlapping layers via the respective curved portions 65 from the developed state shown in FIG. 5.

Out of the respective holes 64 of the sheet body portion 63, the holes (holes 64F, 64M and 64R in the front, middle and rear rows) arranged in the front-rear direction in the developed state are fit to the common protrusion 21 and arranged to communicate on an axis coaxial with that protrusion 21 by the sheet body portion 63 being folded via the respective curved portions 65. As shown in FIG. 2, the flat cable 60 is formed with an extra length portion 66 folded (creased) into three layers overlapping in the vertical direction (projecting direction of the protrusions 21) while surrounding the protrusions 21 via the respective holes 64F, 64M and 64R.

Figure 6:
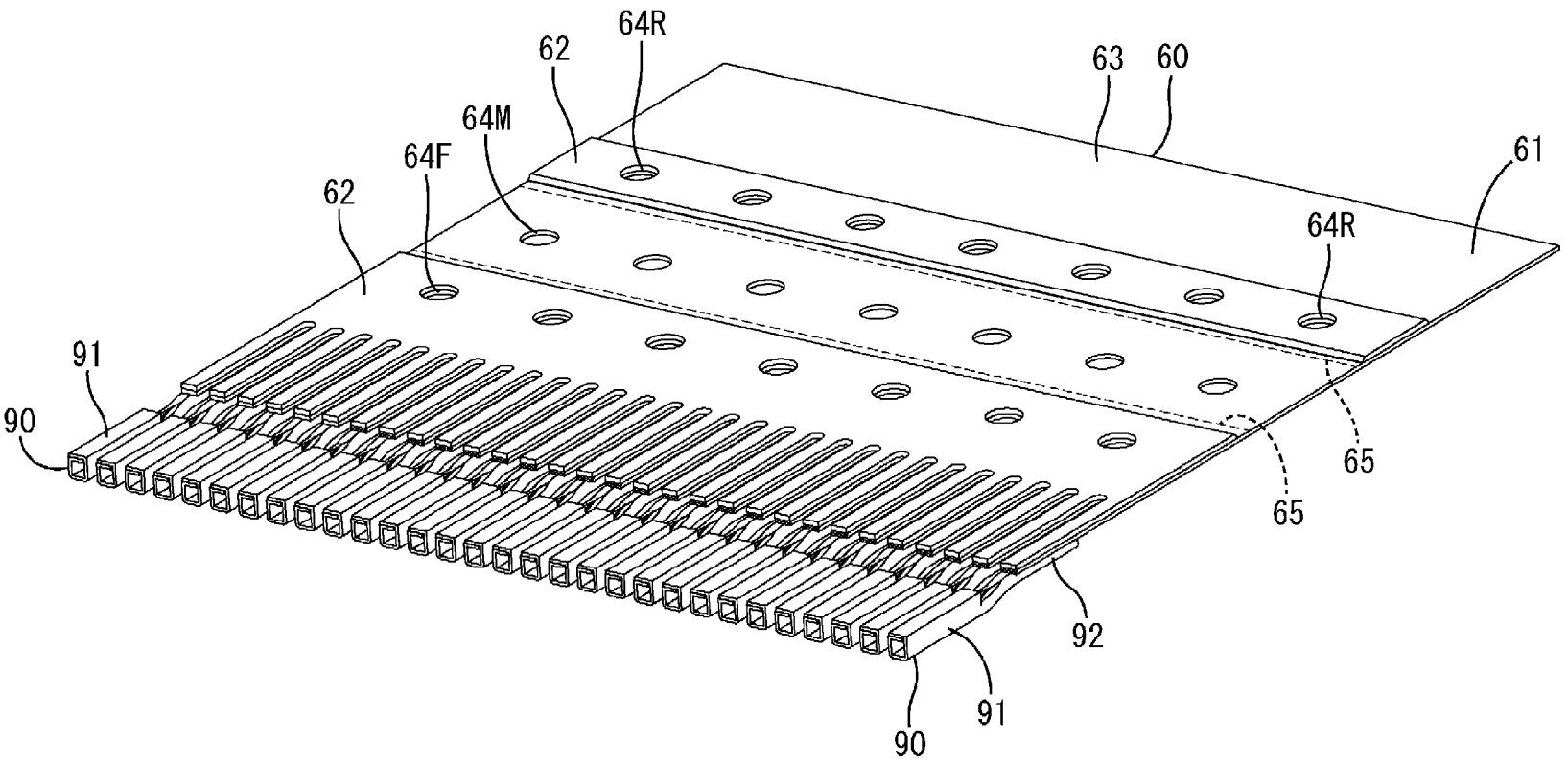
FIG. 6 is a perspective view when the flat cable is viewed from a side opposite to FIG. 5.

The reinforcing members 62 are made of synthetic resin and formed to be higher in rigidity than the sheet member 61. As shown in FIG. 6, the reinforcing members 62 are formed to separately cover a region from the front ends of the respective branch portions 69 to the front curved portion 65 in the developed state and a region from the rear curved portion 65 in the developed state to a position behind the respective holes 64R in the rear row on one surface of the sheet member 61. In other words, there is a region not covered by the reinforcing members 62 between the respective curved portions 65 on the one surface of the sheet member 61. The reinforcing members 62 surround and define the respective holes 64F, 64R in the front and rear rows and cause the respective holes 64 to be open in the one surface side of the flat cable 60.

Next, a manufacturing method, functions and effects of the connector of the first embodiment are described.

In manufacturing the flat cable 60 with the terminals 90, the reinforcing members 62 are overlapped and joined at predetermined positions on the one surface of the sheet member 61 in the developed state by a joining means such as an adhesive prior to drilling. Subsequently, the plurality of holes 64 are formed at once by a drilling part such as a press. Thereafter, the respective terminals 90 are arranged at the respective branch portions 69 on the other surface of the sheet member 61 together with solder paste, and the respective terminals 90 are joined to the sheet member 61 by reflow soldering. According to this manufacturing method, the rigidity of the flat cable 60 is enhanced and a fluctuation of the flat cable 60 on which the respective terminals 90 are disposed can be suppressed during a reflow process. Further, by fixing the flat cable 60 utilizing the respective holes 64, a positional deviation from the respective terminals 90 can be suppressed.

Subsequently, with the one surface side of the flat cable 60 facing downward, each terminal 90 is inserted into each cavity 17 of the lower housing 11 and a front side of the flat cable 60 is placed on the installation surface 19 of the lower housing 11. The terminal 90 is retained and locked in the cavity 17 by the locking lance 18 facing the rear end of the body portion 91 to be able to contact this rear end.

Subsequently, the holes 64F in the front row are fit to the protrusions 21, the flat cable 60 is folded forward from the first curved portion 65 and the holes 64M in the middle row are fit to the protrusions 21 while a rear part of the flat cable 60 is gripped. Further, the flat cable 60 is folded rearward from the next curved portion 65 and the holes 64R in the rear row are fit to the protrusions 21. A part of the flat cable 60 behind the holes 64R in the rear row is directly pulled out rearward of the lower housing 11. In this way, the extra length portion 66 is formed around the protrusions 21 by being folded. Note that, unlike the above method, the extra length portion 66 may be folded in advance via the respective curved portions 65 and the respective holes 64F, 64M and 64R vertically communicating with each other may be fit to the protrusions 21 at once.

The extra length portion 66 is a part providing an extra length as compared to the case where the flat cable 60 is linearly arranged (flat arrangement) along the installation surface 19 of the lower housing 11, and is formed with a sufficient length exceeding clearances between the inner surfaces of the holes 64 and the protrusions 21.

Thereafter, the upper housing 12 is mounted on the lower housing 11 and the lower housing 11 and the upper housing 12 are held in the united state. A tip part of each protrusion 21 is inserted into each escaping hole 31 of the upper housing 12. In the above way, the assembling of the connector is completed.

If a rearward pulling force acts on the flat cable 60 pulled out from the housing 10, clearances between the rear ends of the holes 64R in the rear row and the protrusions 21 are expanded, whereas clearances between the front ends of the holes 64R in the rear row and the protrusions 21 are reduced, and the pulling force is finally received by the contact of the front ends of the holes 64R in the rear row and the protrusions 21 as shown in FIG. 3. The holes 64M in the middle row and the holes 64F in the front row are maintained in a state where front and rear clearances are present between these holes and the protrusions 21, and the pulling force does not act on these parts. Needless to say, the pulling force does not act on connecting parts 50 (see FIG. 2) of the conductors 70 of the flat cable 60 and the terminals 90.

If a forward force acts on the flat cable 60 pulled out from the housing 10, the clearances between the front ends of the holes 64R in the rear row and the protrusions 21 are expanded, whereas the clearances between the rear ends of the holes 64R in the rear row and the protrusions 21 are reduced, and the pulling force is finally received by the contact of the rear ends of the holes 64R in the rear row and the protrusions 21 as shown in FIG. 4. The holes 64M in the middle row and the holes 64F in the front row are maintained in the state where the front and rear clearances are present between these holes and the protrusions 21, and the pulling force does not act on these parts. Needless to say, the pulling force does not act on the connecting parts 50 of the conductors 70 of the flat cable 60 and the terminals 90.

As described above, according to the first embodiment, since the flat cable 60 includes the extra length portion 66 for giving an extra length as compared to the case where the flat cable 60 is flatly arranged along the installation surface 19 in the assembled state, a displacement (positional deviation) of the flat cable 60 due to the clearances between the inner surfaces of the holes 64 and the protrusions 21 can be absorbed by the extra length portion 66. As a result, the application of a stress to the connecting parts 50 of the conductors 70 of the flat cable 60 and the terminals 90 can be avoided, the durability of the connecting parts 50 can be improved and a long life can be realized.

Further, when a pulling force or pressing force acts on the flat cable 60, the protrusions 21 may come into contact with the inner surfaces of the holes 64R. However, in the case of the first embodiment, since the peripheries of the holes 64R are defined by the reinforcing members 62, the shapes of the holes 64R can be prevented from being deformed due to interference with the protrusions 21.

Further, in the case of the first embodiment, since the extra length portion 66 is triply overlapped in the vertical direction while the respective holes 64F, 64M and 64R in the front row, the middle row and the rear row are fit to the common protrusions 21 and surround the protrusions 21, the flat cable 60 can be smoothly assembled while being positioned by the protrusions 21. Furthermore, since this extra length portion 66 is folded, the enlargement of the flat cable 60 in the vertical direction can be avoided. Further, since the extra length portion 66 is unlikely to be detached from the protrusions 21, the positioning reliability of the flat cable 60 can be enhanced.

Second Embodiment

FIGS. 8 to 11 show a second embodiment. In the second embodiment, the shape and arrangement of an extra length portion 66A are different from those of the first embodiment. The configuration of a housing 10 is the same as in the first embodiment and the same description as in the first embodiment is not repeated.

Figure 8:
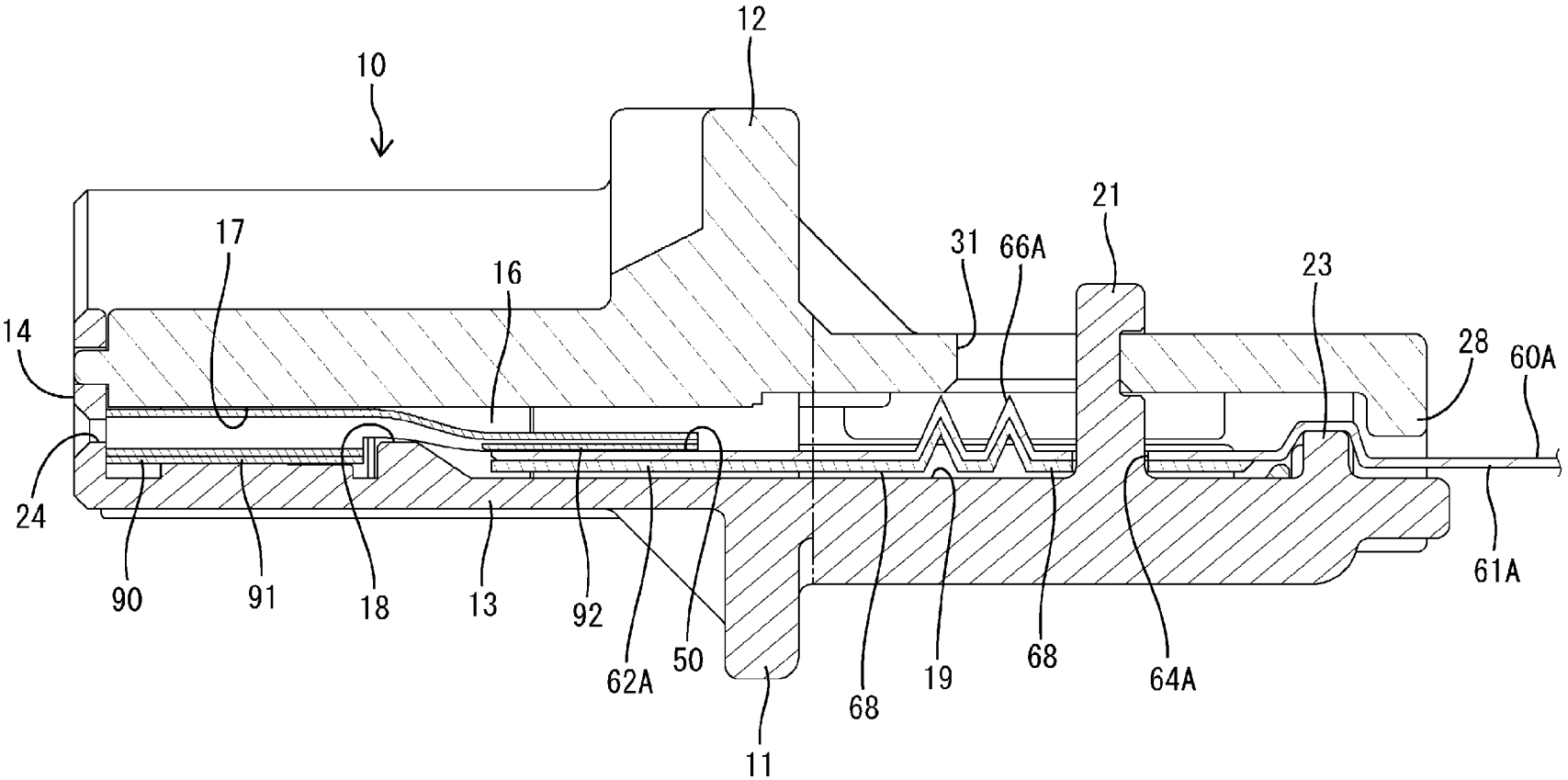
FIG. 8 is a section, corresponding to FIG. 2, of a connector according to a second embodiment.
Figure 9:
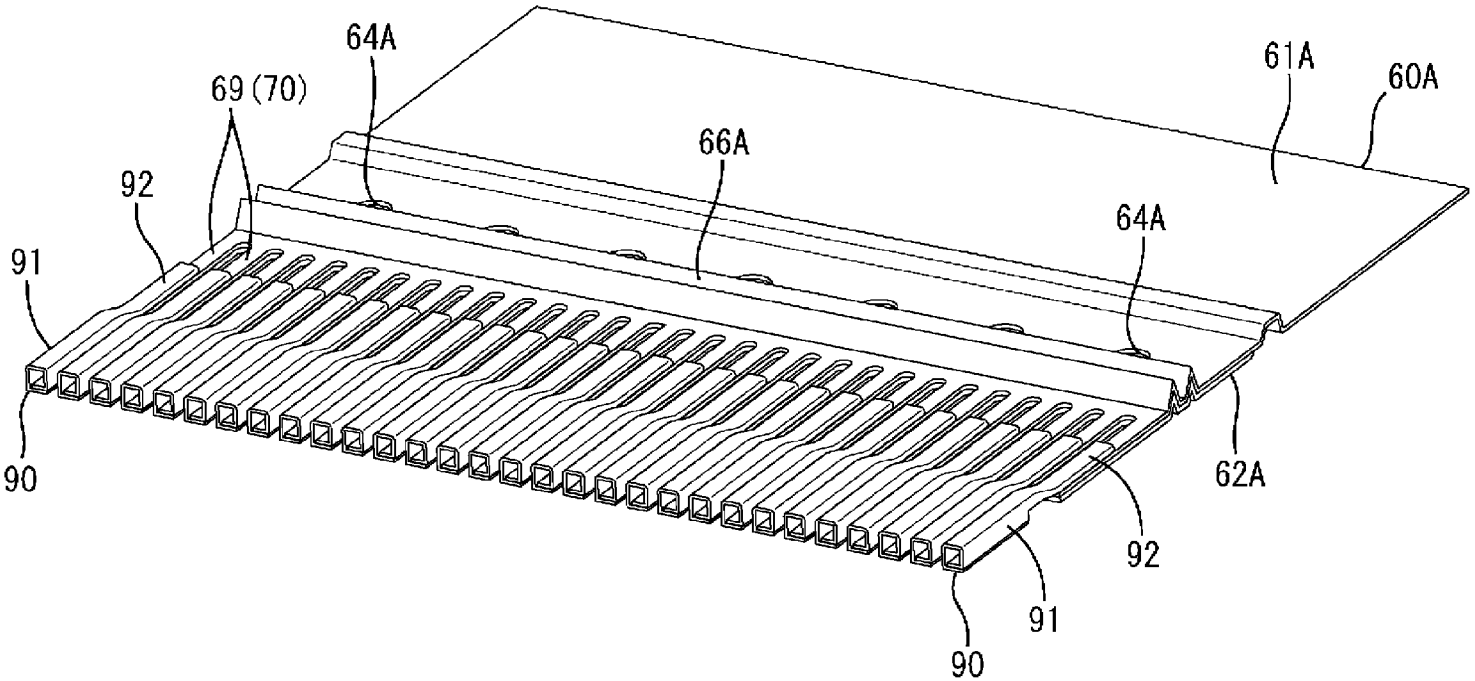
FIG. 9 is a perspective view showing a state where a flat cable having terminals connected thereto is formed with an extra length portion.
Figure 10:
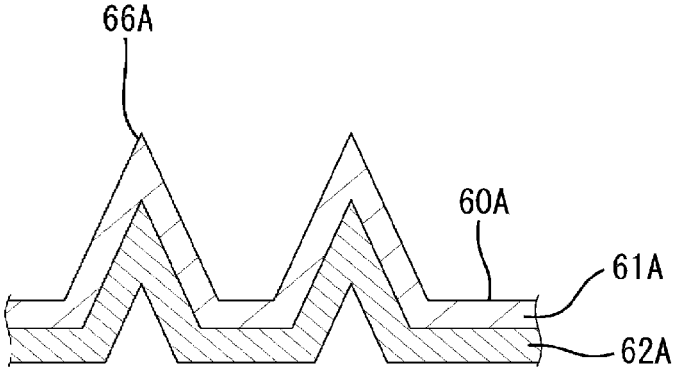
FIG. 10 is a section of the extra length portion when no pulling force or pressing force is acting on the flat cable.
Figure 11:
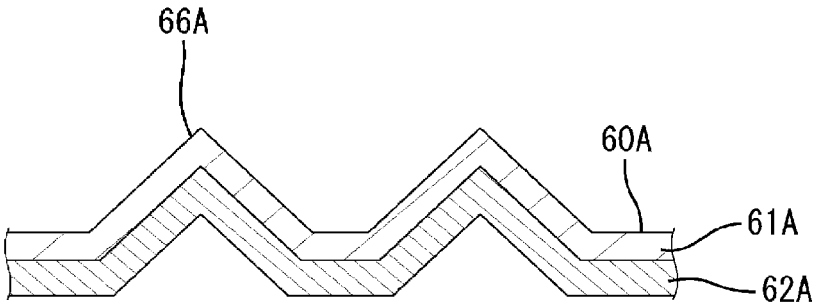
FIG. 11 is a section of the extra length portion when a pulling force is acting on the flat cable.

As shown in FIG. 8, a flat cable 60A includes the extra length portion 66A having a repeated V shape, i.e. an M shape in a shown case, including repeated folds in a front-rear direction between terminals 90 and protrusions 21 in a state assembled with the housing 10. Unlike the first embodiment, the flat cable 60A does not include any vertically overlapping part and holes 64A are provided in a row while being spaced apart in a width direction as shown in FIG. 9, but not arranged side by side in the front-rear direction in a developed state.

Further, as shown in FIG. 8, the flat cable 60A includes flat portions 68 to be linearly arranged (flat arrangement) along an installation surface 19 of a lower housing 11 between terminals 90 and the extra length portion 66A and between the extra length portion 66A and the protrusions 21 in an assembled state.

A reinforcing member 62A is formed to cover a region from the front ends of branch portions 69 to a position behind the holes 64A on one surface of a sheet member 61A. Thus, the reinforcing member 62A includes the extra length portion 66A and the extra length portion 66A has a laminated structure of the sheet member 61A and the reinforcing member 62A. Further, the reinforcing member 62A defines the peripheries of the holes 64A. The extra length portion 66A is formed into a predetermined shape by press-working before the flat cable 60A is assembled with the housing 10.

Here, if the flat cable 60A is assembled with the housing 10 and pulled rearward, the flat cable 60A is retracted in a clearance range between the inner surfaces of the holes 64A and the protrusions 21 and the front ends of the holes 64A and the protrusions 21 come into contact, whereby a retracting displacement is stopped thereafter. During this time, the extra length portion 66A is deformed to expand rearward by a retraction amount of the flat cable 60A to absorb the retracting displacement of the flat cable 60A as shown from FIG. 10 to FIG. 11. Thus, the application of a stress to connecting parts 50 of conductors 70 of the flat cable 60A and the terminals 90 can be avoided and, as in the first embodiment, the durability of the connecting parts 50 can be improved and a long life can be realized.

In the case of the second embodiment, since the extra length portion 66A can be formed in advance, such as by press-working, before the flat cable 60A is assembled with the housing 10, an assembling workload can be reduced.

Further, since the flat portions 68 along the installation surface 19 of the lower housing 11 are provided between the terminals 90 and the extra length portion 66A and between the extra length portion 66A and the protrusions 21, the terminals 90 are not inclined during assembling with the housing 10 and assembling workability can be further improved.

Other Embodiments of Present Disclosure

The embodiments disclosed this time should be considered to be illustrative in all aspects rather than restrictive. For example, the following embodiments can be employed.

(1) The extra length portion may be provided in a folded form (creased state) between the terminals and the protrusion with the flat cable assembled with the housing.

(2) The extra length portion may be, for example, curved without being folded.

(3) In the first embodiment, the extra length portion may be folded into four or more overlapping layers while surrounding the protrusions.

(4) In the first embodiment, the curved portions may be bent at an acute angle like folds.

(5) In the second embodiment, the extra length portion may be V-shaped or inverted V-shaped.

(6) The reinforcing member(s) may be omitted from the flat cable.

(7) Receiving portions may be formed such that the protrusions are inserted thereinto to be locked. For example, a recess formed by cutting a side edge of a flat cable may be used as a receiving portion.

LIST OF REFERENCE NUMERALS

10 . . . housing
11 . . . lower housing
12 . . . upper housing
13 . . . base wall portion
14 . . . front wall portion
15 . . . side wall portion
16 . . . separation wall
17 . . . cavity
18 . . . locking lance
19 . . . installation surface
21 . . . protrusion
22 . . . fitting recess
23 . . . lower ridge
24 . . . insertion hole
25 . . . lock receiving portion
26 . . . covering wall portion
27 . . . lock arm
28 . . . upper ridge
29 . . . lock portion
31 . . . escaping hole
50 . . . connecting part
60, 60A . . . flat cable
61, 61A . . . sheet member
62, 62A . . . reinforcing member
63 . . . sheet body portion
64, 64A . . . hole (receiving portion)
64F . . . hole in front row
64M . . . hole in middle row
64R . . . hole in rear row
65 . . . curved portion
66, 66A . . . extra length portion
68 . . . flat portion
69 . . . branch portion
70 . . . conductor
90 . . . terminal
91 . . . body portion
92 . . . conductor connecting portion

What is claimed is:

1. A connector, comprising:
a lower housing and an upper housing;
a flat cable to be arranged between the lower housing and the upper housing; and
a plurality of terminal fittings to be mounted on an end part of the flat cable,
wherein:
the lower housing has an installation surface, the flat cable being laid on the installation surface, a projecting part projecting on the installation surface, and a locking lance,
the flat cable includes a conductor and has a movement on the installation surface restricted by the projecting part,
the terminal includes a conductor connecting portion to be soldered to the conductor of the flat cable and a body portion to be locked by the locking lance,
the lower housing includes a base wall portion,
cavities partitioned by a separation wall are provided side by side in a width direction in a front part of an upper surface of the base wall portion,
the terminal fittings are inserted into the cavities,
the locking lance is provided to project on a front part of the upper surface of the base wall portion, and
the installation surface is provided continuously with the front part of the upper surface of the base wall portion in a rear part of the upper surface of the base wall portion.

2. The connector according to claim 1, wherein:
the projecting part includes a lower ridge extending in the width direction on the installation surface, and
the flat cable has a part to be held between the lower ridge and the upper housing.

3. The connector according to claim 2, wherein the upper housing includes an upper ridge for bending and holding the flat cable between the lower ridge and the upper ridge.

4. The connector according to claim 1, wherein:
the projecting part includes a protrusion, and
the flat cable includes a hole into which the protrusion is inserted.

5. The connector according to claim 4, wherein positional deviations between the flat cable and the terminals are suppressed by fixing the flat cable, utilizing the hole.

6. The connector according to claim 1, wherein the upper housing includes a lock arm for holding a mating housing in a connected state.

7. The connector according to claim 1, wherein:
the lower housing includes a lock receiving portion, and
the upper housing includes a lock portion for holding the lower housing and the upper housing in a united state by locking the lock receiving portion.

* * * * *